US008137084B2

(12) United States Patent
Malhoutra et al.

(10) Patent No.: US 8,137,084 B2
(45) Date of Patent: Mar. 20, 2012

(54) INTERLOCKING DEVICE FOR HOLDING BODY AND FLANGE OF MACHINES USING BEAN-SHAPED DOWELS

(75) Inventors: Udayant Malhoutra, Bangalore (IN); Pradip Kumar Ray Chaudhuri, Bangalore (IN)

(73) Assignee: Dynamatic Technologies Limited, Karnataka (IN)

( * ) Notice: Subject to any disclaimer, the term of this patent is extended or adjusted under 35 U.S.C. 154(b) by 852 days.

(21) Appl. No.: 11/992,759

(22) PCT Filed: Mar. 3, 2006

(86) PCT No.: PCT/IB2006/000761

§ 371 (c)(1),
(2), (4) Date: Mar. 28, 2008

(87) PCT Pub. No.: WO2007/036766

PCT Pub. Date: Apr. 5, 2007

(65) Prior Publication Data

US 2010/0150765 A1 Jun. 17, 2010

(30) Foreign Application Priority Data

Sep. 28, 2005 (IN) ..... 892/KOL/2005

(51) Int. Cl.
*F03C 2/00* (2006.01)
*F03C 4/00* (2006.01)
*F04C 2/00* (2006.01)

(52) U.S. Cl. ..... 418/132; 418/104; 418/206.1; 418/206.6; 418/206.9

(58) Field of Classification Search ..... 418/104, 418/132, 206.1, 206.6–206.9
See application file for complete search history.

(56) References Cited

U.S. PATENT DOCUMENTS

| | | | | |
|---|---|---|---|---|
| 2,993,450 | A * | 7/1961 | Weigert | 418/132 |
| 4,281,974 | A * | 8/1981 | Teruyama | 418/132 |
| 4,330,241 | A * | 5/1982 | Spurry | 418/132 |
| 4,337,018 | A * | 6/1982 | Singer et al. | 418/132 |
| 2005/0106055 | A1 * | 5/2005 | Lipscombe | 418/206.1 |

FOREIGN PATENT DOCUMENTS

| | | |
|---|---|---|
| EP | 1 531 269 | 5/2005 |
| GB | 403636 | 12/1933 |
| GB | 2 233 712 | 1/1991 |
| GB | 2 247 923 | 3/1992 |
| GB | 2 408 070 | 5/2005 |

OTHER PUBLICATIONS

International Search Report dated Jun. 27, 2006.

* cited by examiner

*Primary Examiner* — Theresa Trieu
(74) *Attorney, Agent, or Firm* — Jacobson Holman PLLC

(57) ABSTRACT

An interlocking device for rigidly holding together the body and flange of a hydraulic machine includes a body, flange, gears, sealing elements acting as a body seal and lobe seal adapted to effectively seal pressurized oil pockets within the hydraulic machine with a back-up ring that prevents squeezing of the lobe seal and to retain it in its original position, appropriately dimensioned bush bearings adapted to act as load bearing journals. The interlocking device includes a plurality of bean-shaped dowels located at both inlet and outlet sides that hold the body and flange together with minimum relative displacement to ensure high volumetric efficiency of the hydraulic machine even at high operating pressures in excess of 275 bar or higher.

6 Claims, 12 Drawing Sheets

INTERLOCKING DEVICE FOR HOLDING BODY AND FLANGE OF MACHINES USING BEAN-SHAPED DOWELS

This is a national stage of PCT/IB2006/000761 filed Mar. 3, 2006 and published in English.

FIELD OF THE INVENTION

The present invention relates to an interlocking device for rigidly holding together the body and flange of machines particularly a hydraulic machine using bean-shaped dowels. The interlocking mechanism according to the present invention can be employed for hydraulic pumps, motors, valves, etc. where containment of pressurized fluid is required with due consideration for minimal deflection of the load bearing elements.

The present invention comprises an improvement of the invention disclosed in a co-pending International (PCT) application by the same applicant, for an interlocking device for holding body and flange of hydraulic machines using oval-shaped dowels (hereinafter referred to as the main invention).

BACKGROUND OF THE INVENTION

For the effective functioning of a hydraulic machine, it is essential that the relative positional displacement amongst the various component parts, viz., body, flange and cover is controlled within reasonable limits. This factor helps to maintain reduced clearance between the gear tip circle diameter and the bore of the body, so that the hydraulic machine's volumetric efficiency can be kept optimum at various levels of oil pressure.

The desired performance is met by the hydraulic machine construction by employing positive close fit dowel arrangement between the flange and the body. Such a construction ensures that the relative movement amongst these two components is minimal.

Presently, the design of hydraulic machines is such that they are provided with dowels disposed on the body at the inlet side in case of two hollow dowels and at both inlet and outlet sides in case of four hollow dowels. These hollow dowels accommodate the mounting bolts of the hydraulic machine to pass through.

FIG. 1 of the drawings accompanying the specification depicts the profile of a pump body used in a conventional gear pump. Gear pumps using such profile and having two hollow dowels are, and can be, employed satisfactorily for applications requiring up to 3000 lbs./in$^2$ (207 bar) oil pressure. The hollow dowels used in the body of a conventional gear pump is shown in FIG. 2 of the drawings accompanying the specification.

FIG. 3 of the drawings accompanying the specification shows the profile of a gear pump body used in a conventional gear pump where the application pressure required is high. Gear pumps using such profile and having four hollow dowels are, and can be, employed satisfactorily for applications requiring up to 4000 lbs./in$^2$ (275 bar) oil pressure.

It is known from GB-A-2247923 to provide one or both ends of the housing with a non-circular inner rim which is received within a recess of matching non-circular shape defined by a flange projecting from a peripheral region of a respective end cover in a direction parallel to the axis of rotation of the meshing rotors. One or both open ends of the housing is thus supported by its end cover against outward deflection under the effect of fluid pressure in the chambers in a plane transverse to the axes of rotation of the meshing rotors.

GB-A-2247923 further discloses that the non-circular inner rim and matching non-circular recess are difficult to machine accurately and require complex CNC programming. Also, although this arrangement provides good alignment and support in a direction normal to the aforesaid plane (i.e. in the direction of the minor axis), no support is given in the direction of the major axis. Under the influence of internal pressure, the major sides of the housing deflect outwards to a small extent whilst the minor sides of the housing contract away from the mating edges of the peripheral flange on the end cover. The flange thus only limits body deflection in an outwards direction. Furthermore, there has to be an axial clearance between the peripheral flange and the end face of the housing in order to ensure that the end face of the inner rim seats against the base of the recess. The end cover is secured to the housing by bolts and this axial clearance results in a bolt load overhang which imposes a considerable bending load on the flange profile.

It is also known from GB 2408070A to provide a rotary positive displacement hydraulic machine in the form of a gear pump or motor comprising defining two mutually intersecting parallel working chambers having a low pressure inlet side and a high pressure outlet side, two meshing rotors mounted for rotation in the two chambers respectively, and two bearing supports at opposite ends of the chambers and each supporting bearings in which the two rotors are journalled for rotation, wherein at least one end of the housing is closed by a separate end cover and wherein the separate end cover and an adjacent end of the housing each has at least one elongated recess on each of the two major sides of the working chambers, the recesses in the end cover being alignable with respective recesses in the adjacent end of the housing and there being at least one keying element in each pair of aligned recesses so that the open end of the housing is supported against outward deflection by differential fluid pressure in the chambers in a direction transverse to a plane containing the axes of rotation of the meshing rotors.

There was a long-felt need in the art for an interlocking device for hydraulic machines, in particular, gear pumps operating at pressure in excess of 275 bar that prevents the undue relative displacement and the undesirable orientation of the gear pump body with respect to its flange and cover. A higher relative displacement between the structural component parts, of the gear pump will correspondingly lower the performance of the pump, particularly its volumetric efficiency, as discussed above. A crucial factor, and hence a matter of concern for gear pump designers, is the effectiveness of the doweling arrangement to prevent relative displacement of the pump body and the flange at the operating pressure.

Therefore, the strategy for improving the effectiveness of the interlocking arrangement is considered as a major step towards achieving high pump performance levels with increased volumetric efficiency.

With the above objective, the present invention is oriented towards optimizing the configuration of the dowel, i.e., its shape and size and also its disposition on the body of the hydraulic machine. This critical shape and size of the locating dowel and its optimal positioning have been arrived at in the present invention through in-depth estimation of the hydraulic forces occurring inside the pump body, which significantly behaves like a close knit pressure vessel, while being in high pressure operation.

In order to identify the optimum interlocking concept, pump interlocking arrangement using four bean-shaped dowels (as depicted in FIG. 4 of the accompanying drawings) has been evaluated for gear pumps operating at higher application pressure in the range of 330 bar, and compared for the relative strength and optimality with respect to the conventional hollow dowel arrangement.

The location of occurrence for the maximum stress and deflection position are different in the bean-shaped dowel arrangement according to the present invention as compared to the oval-shaped dowel arrangement invention according to the main invention, due to variation in the body profile and dowel profile and location. The optimality in deflection and stress for the body of a hydraulic machine while being used under extreme operating conditions makes it clear that the bean-shaped dowel arrangement is an improvement upon the oval-shaped dowel arrangement, as elucidated in further detail in the description hereinafter.

SUMMARY OF THE INVENTION

Accordingly, the present invention provides an interlocking device for rigidly holding together the body and flange of a hydraulic machine comprising a body, flange, gears, sealing means acting as body seal and lobe seal adapted to effectively seal pressurized oil pockets within the hydraulic machine with a back-up ring that prevents squeezing of said lobe seal and to retain it in its original position, appropriately dimensioned bush bearings adapted to act as load bearing journals, wherein said interlocking device comprises a plurality of bean-shaped dowels located at both inlet and outlet sides that hold the body and flange together with minimum relative displacement to ensure high volumetric efficiency of said hydraulic machine even at high operating pressures in excess of 275 bar.

Preferably, the number of bean-shaped dowels used is four. The curvilinear major axis of each, of the bean-shaped dowels is aligned at right angle with the resultant force direction and their minor axis at the axis of symmetricity are aligned with the resultant force direction. The width of said body is proportional to the fluid flow capacity. Said body is made from high grade specially alloyed cast iron or aluminium materials depending upon the application and pressure ratings. Said gears are made from special steels. Said flange is made from cast iron castings. The profiles of said body and the flange are such that adequate reinforcing is maintained at appropriate zones to enhance its load bearing capacity and its rigidity.

Both said body and said flange are equipped with a provision for accommodating said bean-shaped, interlocking dowels. The profile of the lobe seal material matches with that of the corresponding pressure plate. Said bush bearings, which are used as a load bearing journal, are PTFE lined.

It would appear clear to persons skilled in the art that numerous developments and modifications are possible without departing from the scope and spirit of the invention, which has been described for illustrative purposes only, by way of example of an interlocking device for rigidly holding together the body and flange of a hydraulic machine, wherein said hydraulic machine is a gear pump.

BRIEF DESCRIPTION OF THE ACCOMPANYING DRAWINGS

Embodiments of the invention for use with a hydraulic gear pump, will now be described by way of example only, with reference to the accompanying drawings wherein.

| Sl. No. | Parts Description | Qty. |
|---|---|---|
| 1 | Pump Body | 1 |
| 2 | Flange | 1 |
| 3 | Bean Dowel | 4 |
| 4 | Stud | 4 |
| 5 | Nut | 4 |
| 6 | Washer | 4 |
| 7 | O-Ring | 1 |
| 8 | DU Bush | 4 |
| 9 | Backup Ring | 2 |
| 10 | Lobe seal | 2 |
| 11 | Pressure Plate | 2 |
| 12 | Driveshaft & Gear | 1 |
| 13 | Driven Gear | 1 |
| 14 | Shaft Seal | 1 |
| 15 | Circlip | 1 |

DESCRIPTION OF THE PREFERRED EMBODIMENTS

Finite element analysis (FEA) was carried out for the conventional interlocking mechanism and for the interlocking mechanism according to the present invention for a pressure range of 207 bar which the conventional interlocking devices are able to withstand, while applying to a similar pump body profile. The FEA results are given in Table-1.

TABLE 1

Summary of Deflection and Stress Analysis

| Sl. | Type of Interlocking Between Pump Body and Flange | Maximum Deflection Value in Micron | Maximum Deflection Location | Maximum Stress Value in $N/mm^2$ | Maximum Stress Location |
|---|---|---|---|---|---|
| 1 | 2 Hollow Dowels (Conventional) | 45 | Inlet Porting | 355 | Inlet Side Dowel Holes |

TABLE 1-continued

| Summary of Deflection and Stress Analysis | | | | | |
|---|---|---|---|---|---|
| | Type of Interlocking | Maximum Deflection | | Maximum Stress | |
| Sl. | Between Pump Body and Flange | Value in Micron | Location | Value in $N/mm^2$ | Location |
| 2 | 4 Hollow Dowels (Conventional) | 30 | Outlet Porting | 516 | Outlet Side Dowel Holes |
| 3 | 4 Bean-Shaped Dowels (according to the invention) | 28 | Inlet and Outlet Porting | 345 | Inlet Bolt Holes |

The FEA results indicate that although the bean-shaped dowels with built-in bolt hole result in near equal magnitude of deflection with respect to the four hollow dowel configuration, it guarantees a better performance level since the maximum principle stress magnitude is less which satisfies the requisite criteria from fatigue life considerations. The above table thus provides an indication of the resilience of bean-shaped dowels to withstand a higher pressure range, in view of low values of both deflection and stress for the configuration.

Having identified that a bean-shaped doweling arrangement is the optimum solution for a gear pump-flange interlocking arrangement, effort was channelized to arrive at an ideal pump body profile.

The preferred embodiments of the invention are described below with reference to the drawings.

Figure 5:
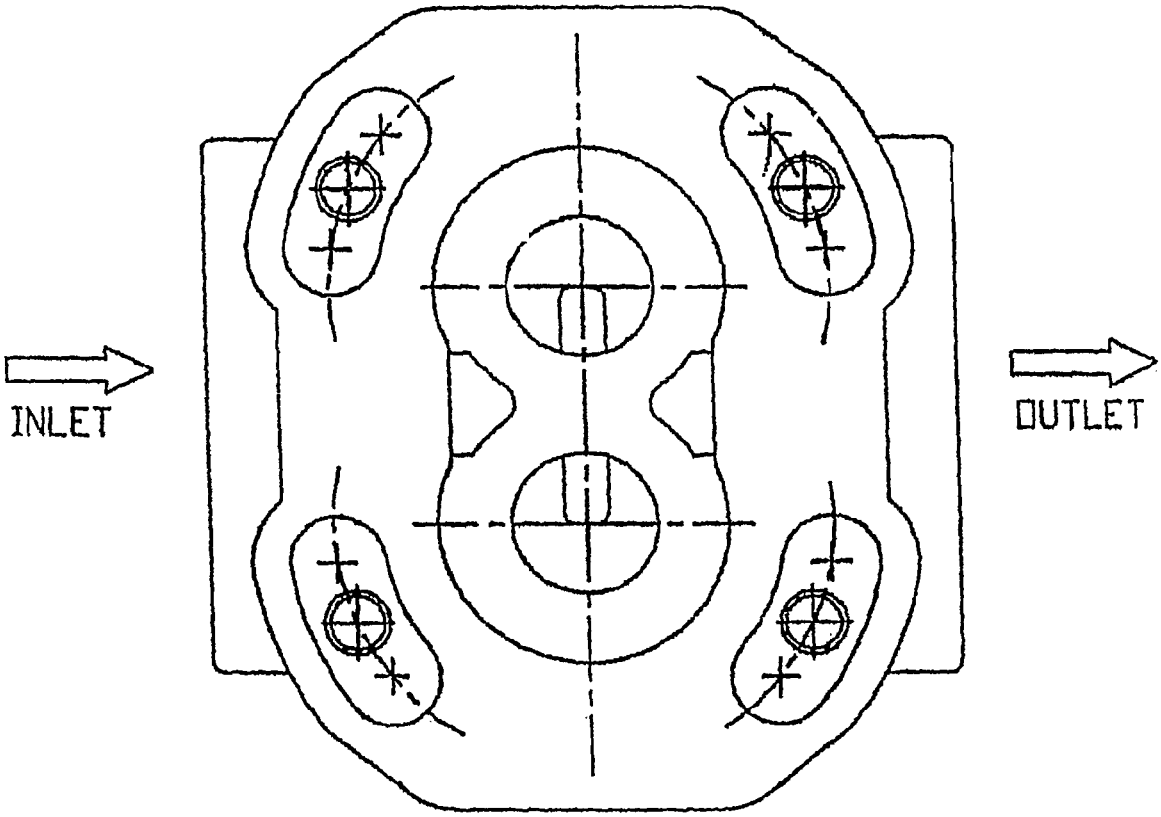
FIG. 5 depicts the optimized profile of a body of a pump using bean-shaped dowels.

FIG. 5 represents the optimized profile of the pump body according to the present invention using bean-shaped dowels.

Figure 6:
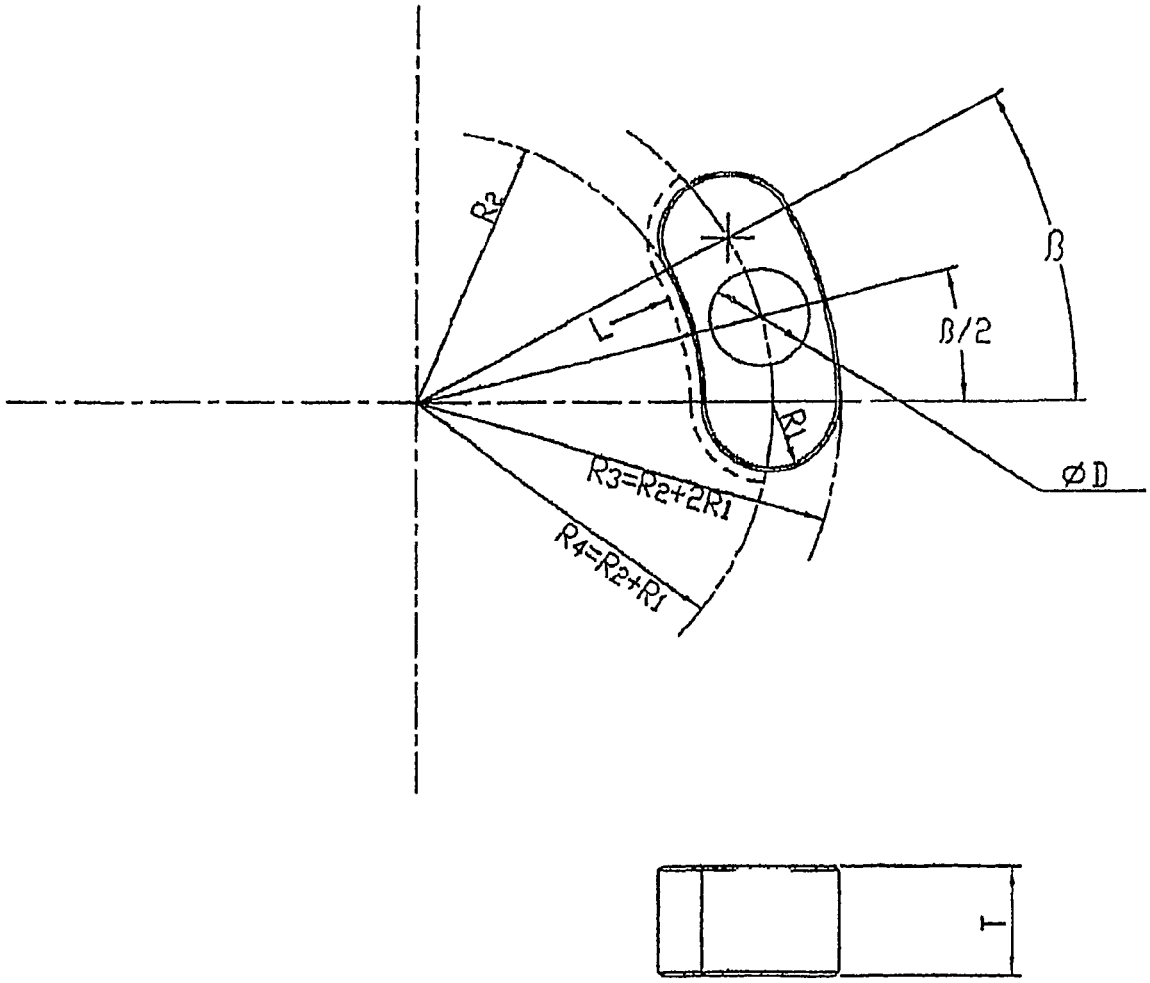
FIG. 6 shows a bean-shaped dowel for a pump body.

FIG. 6 shows a bean-shaped dowel for a pump body according to the present invention.

In order to account for the benefits accruing out of an interlocking mechanism using bean-shaped dowels over conventional hollow dowels, both a conventional and a pump body profile according to the present invention having a body width proportional to a similar flow capacity are taken into consideration. The profile of the pump body according to the present invention must necessarily be different from that of the conventional body profile in order to attain optimality from the strength point of view.

Figure 7:
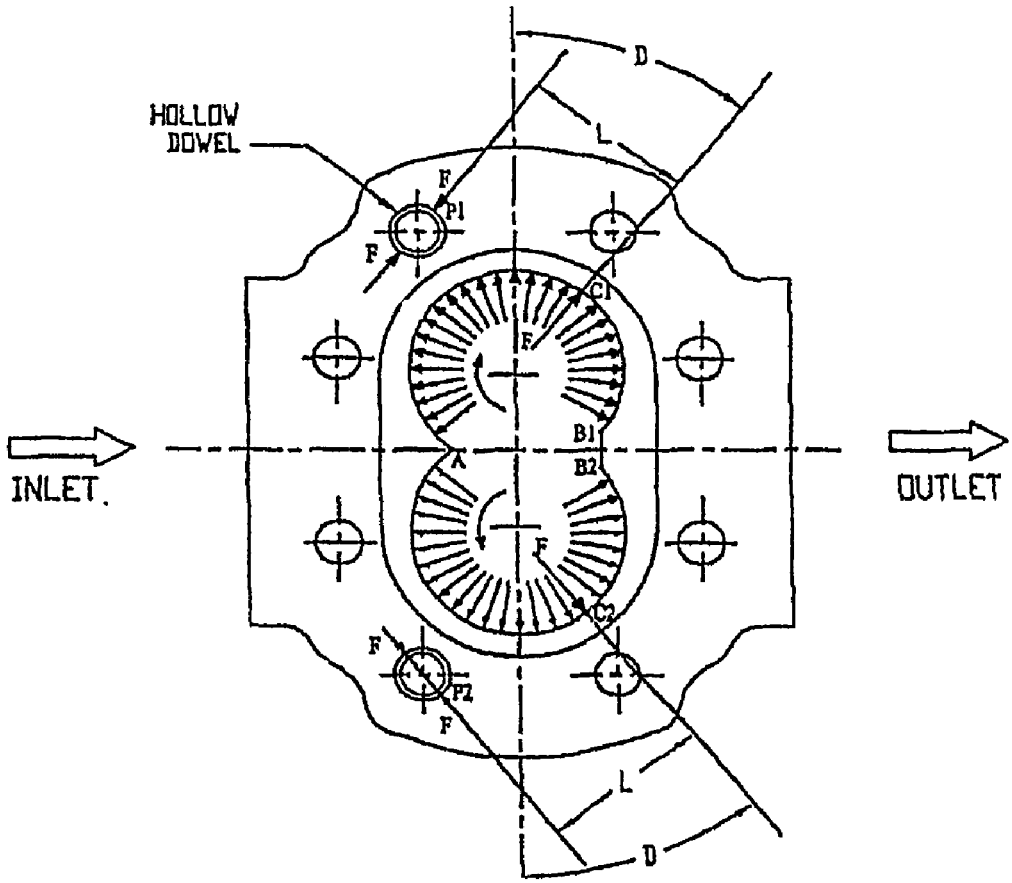
FIG. 7 is a free body diagram for a conventional pump body with oil pressure loading.

The force and maximum stress for a conventional pump body using hollow dowel construction was estimated and FIG. 7 represents the free body diagram for a conventional pump body profile with indication of oil pressure from the suction side at "A" to maximum outlet pressure at position B1 (or B2). The maximum pressure is assumed to be as 250 bar. As can be seen from FIG. 7, the resultant force "F" can be resolved into coplanar force "F" acting at the hollow dowel at the location P1 (or P2) along with a turning couple of magnitude F×L. The couple tends to cause bending of the body halves about the hollow dowel axis P1 (or P2). This phenomenon is detrimental since it tends to increase the tip circle clearance at the gear outer diameter cum body bore interface at the high pressure outlet side.

In FIG. 7—

$F$ = RESULTANT FORCE ACTING ON THE PUMP BODY
= 3466 Kgf. *

$D$ = ANGULAR LOCATION OF RESULTANT FORCE
= 38° *

-continued

* NOTE: THE VALUES OF RESULTANT FORCE AND ITS ANGULAR LOCATION ARE SPECIFIC TO THE PROFILE OF THE BODY BORE GEOMETRY.

Figure 1:
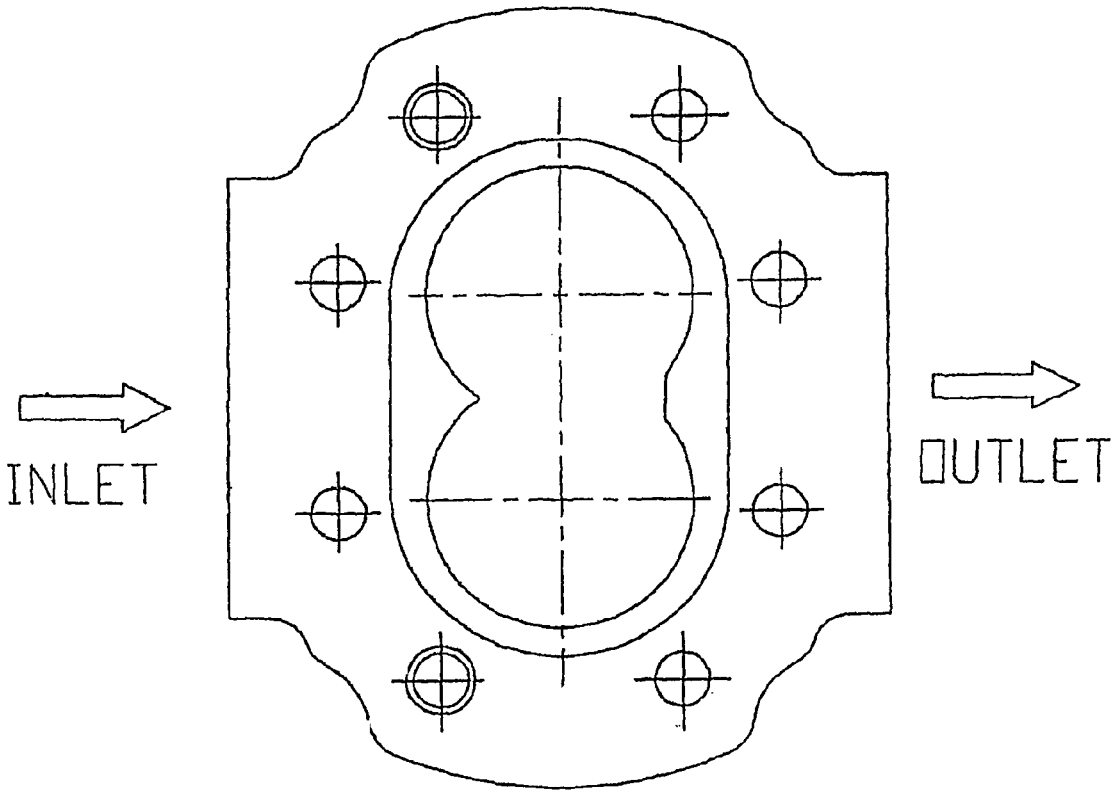
FIG. 1 shows the profile of a pump body used in a conventional gear pump.
Figure 2:
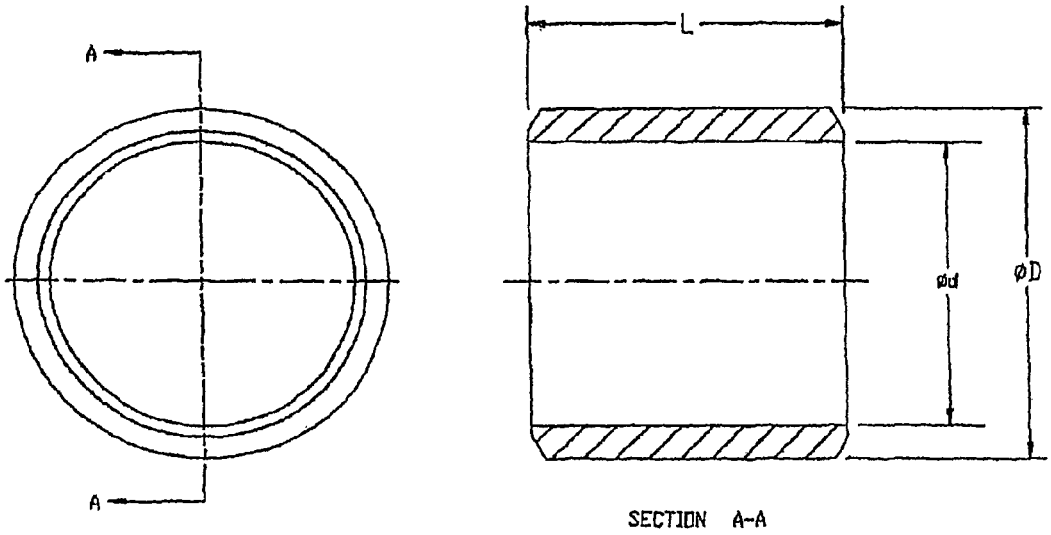
FIG. 2 shows the hollow dowels used in the body of a conventional gear pump.
Figure 3:
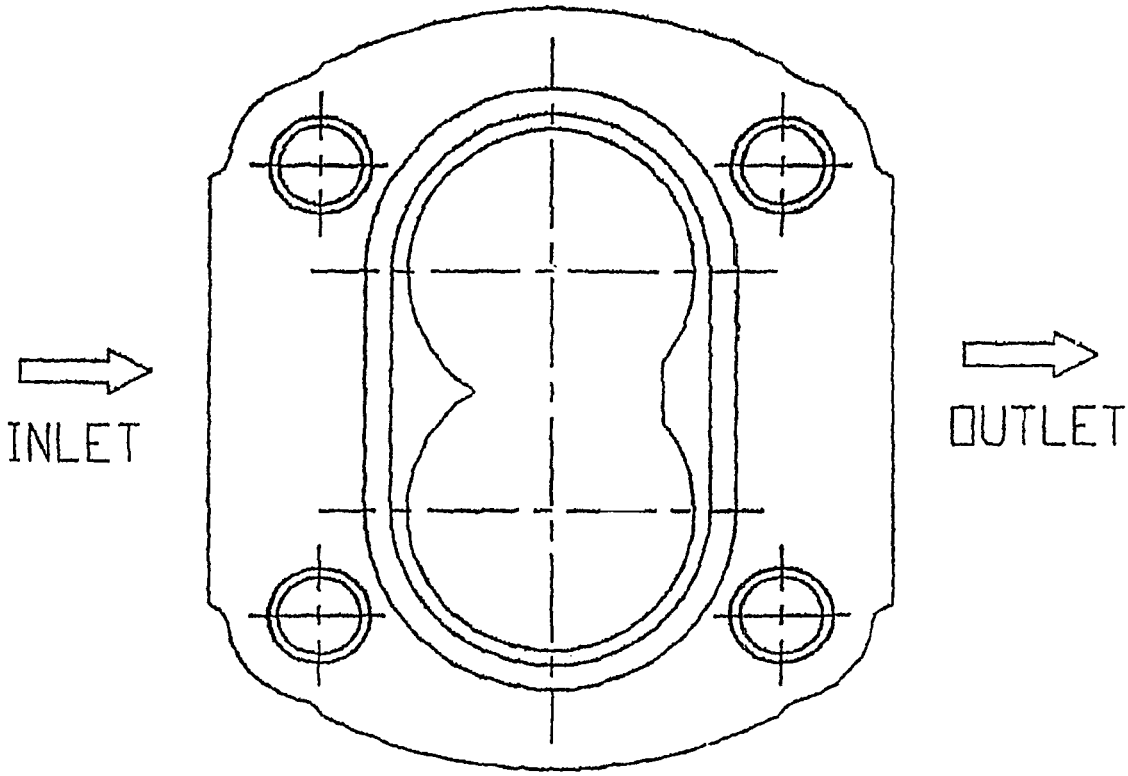
FIG. 3 shows the profile of a gear pump body used in a conventional gear pump where the application pressure required is high.
Figure 4:
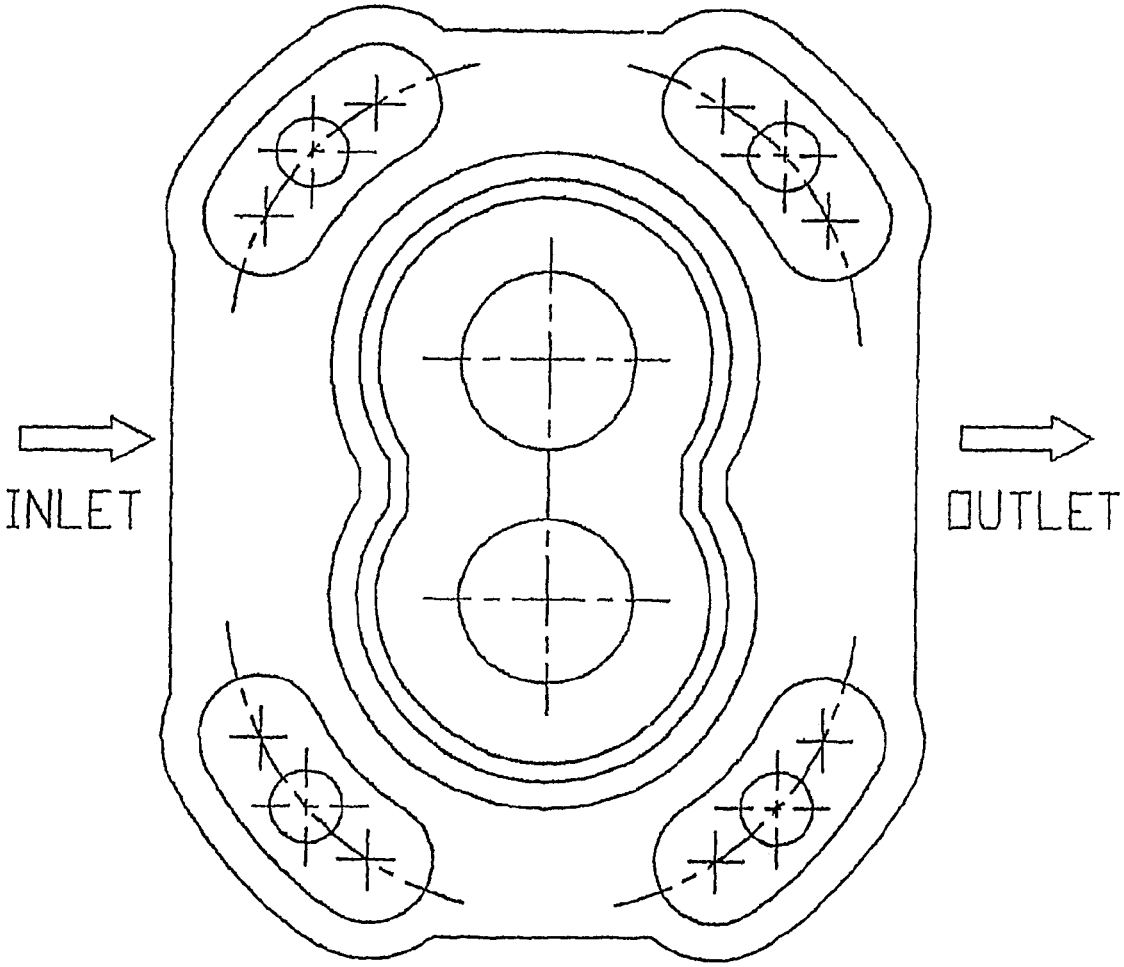
FIG. 4 shows pump interlocking arrangement using four bean-shaped dowels according to the present invention.

Also, the 3466 kgf force acts on a slender hollow dowel projected area of [{(3.142×13)/2}×11] sq. mm.=224.6 sq mm (Refer FIG. 2 with D and L as 13 min and 11 mm respectively) and the net compressive stress on each of the hollow dowel amounts to 3466/224.6=15.4 kgf/sq. mm. The maximum bearing pressure for the dowel made of EN 8 material specification is allowed between 10 to 12 kgf/sq. mm. Hence, this clearly indicates that the maximum compressive stress is on the higher side.

Figure 8:
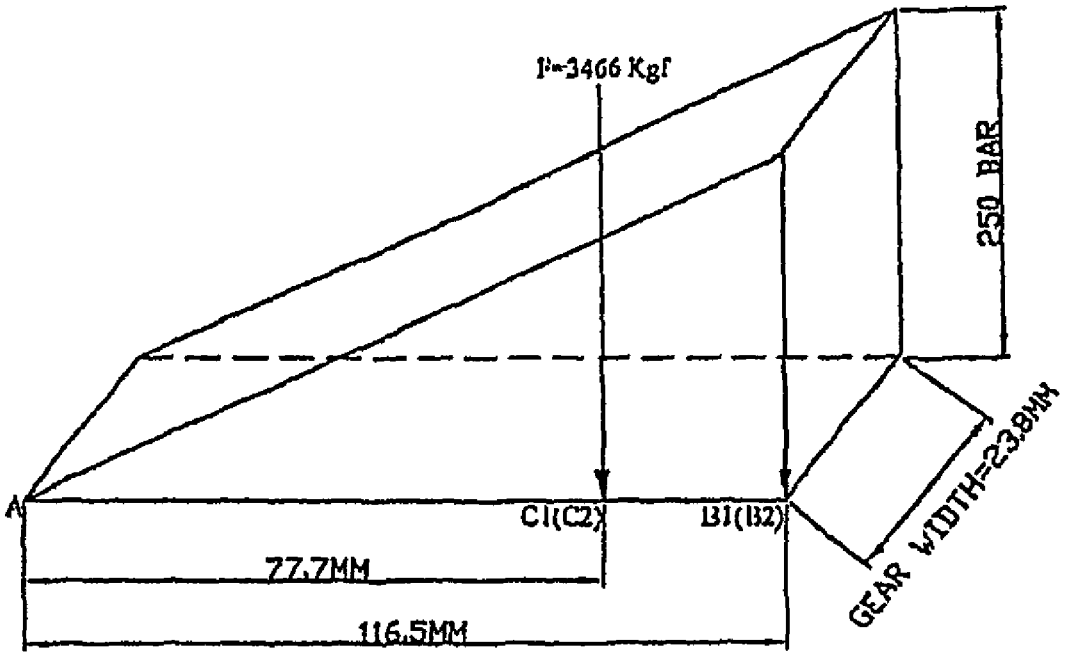
FIG. 8 is a linear representation of a force diagram within a conventional pump body.

FIG. 8 details the linear representation of force diagram as occurring within a conventional pump body. The total resultant force amounts to 3466 kgf and occurring at the position C1 (or C2) oriented at an angle of 38 degrees with respect to the vertical axis (as shown in FIG. 7). The values of resultant force and its angular location are specific to the profile of the body bore geometry. The resultant force and its location can be calculated from FIG. 8 in the following manner:

$F$=½*[(ARC LENGTH $A$–$B$1(OR $A$–$B$2)IN MM)*MAXIMUM OIL PRESSURE IN BAR*GEAR WIDTH IN MM]/(10*10)Kgf $F$=½*116.5*250*23.8/(10*10)Kgf

F=3466 Kgf.

Location of Resultant Force—

$$C1(C2) = 2/3 * 116.5$$
$$= 77.7 \text{ MM}$$

The force and maximum stress for the pump body with bean-shaped dowel construction according to the invention was estimated. While making a comparative analysis for the pump body using the bean-shaped dowel according to the invention, the body profile was correspondingly modified to accommodate the bean-shaped dowel.

The stress induced in the dowels is computed using the following mathematical relationship:

For hollow dowel:

D=Dowel outer diameter

T=Dowel thickness

F=Resultant force acting on the dowel

Projected dowel area, A=(π*D)/2*T

Net Compressive Stress on Dowel, S=F/A

For Bean-Shaped Dowel:

L=projected length of the dowel

T=Dowel thickness

F=Resultant force acting on the dowel

Projected dowel area, A=L*T

Net Compressive Stress on Dowel, S=F/A

Figure 9:
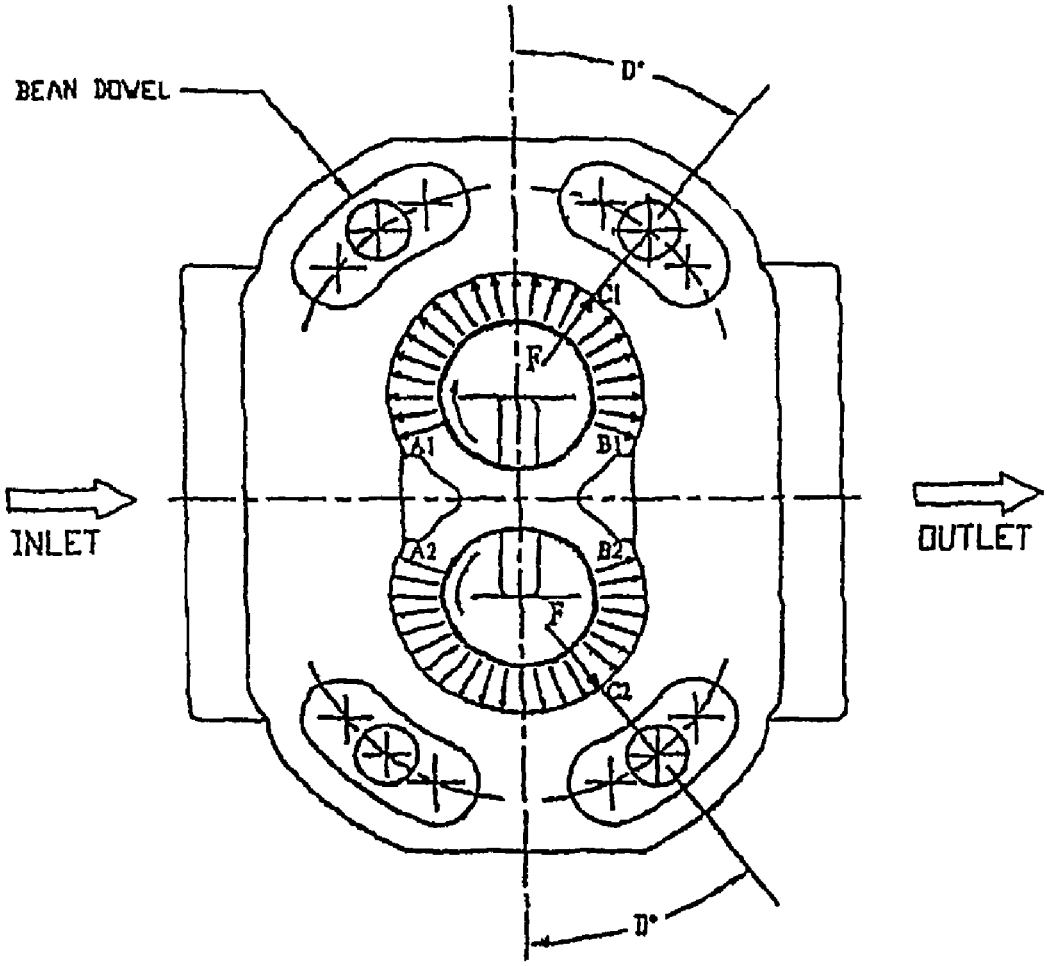
FIG. 9 is a free body diagram for a pump body according to the present invention with oil pressure loading.

FIG. 9 represents the free body diagram for the pump body profile according to the present invention with indication of oil pressure variation from the suction side at A1 (or A2) to the maximum outlet pressure at position B1 (or B2). The maximum pressure was assumed to be 250 bar.

In FIG. 9—

$F$ = RESULTANT FORCE ACTING ON THE PUMP BODY = 4953 Kgf. *

$D$ = ANGULAR LOCATION OF RESULTANT FORCE = 38° *

* NOTE: THE VALUES OF RESULTANT FORCE AND ITS ANGULAR LOCATION ARE SPECIFIC TO THE PROFILE OF THE BODY BORE GEOMETRY.

Figure 10:
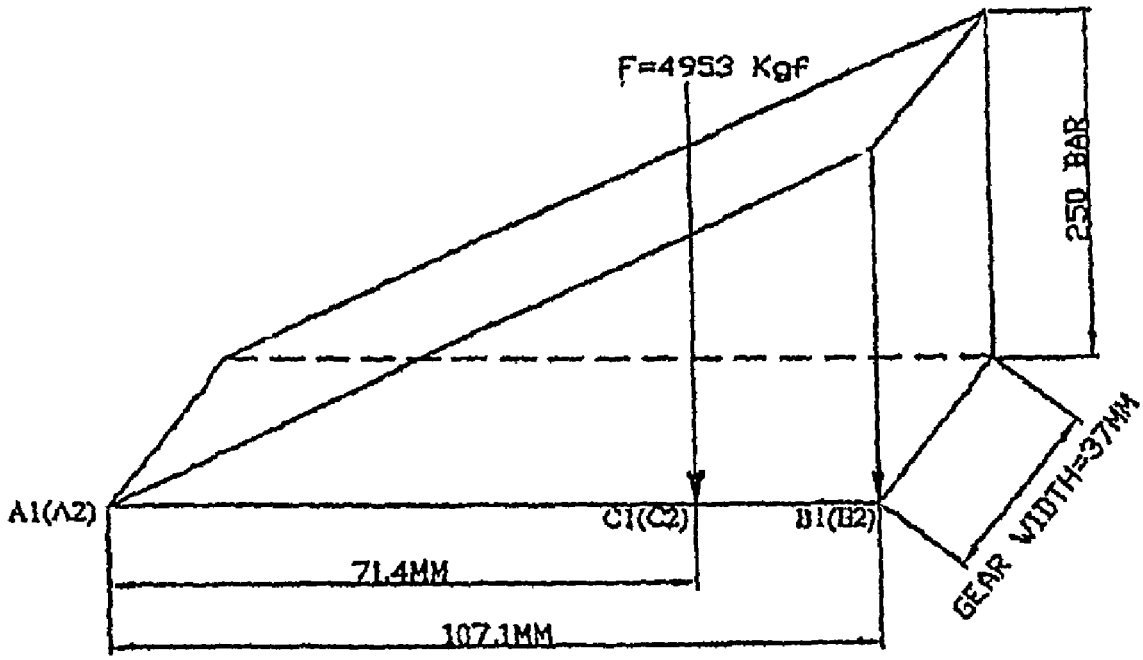
FIG. 10 is a linear representation of force diagram within a pump body according to the present invention.

FIG. 10 details the linear representation of force diagram as occurring within a pump body according to the present invention. The total resultant force amounts to 4953 kgf and occurring at the position C1 (or C2) oriented at an angle of 38 degrees with respect to the vertical axis (as shown in FIG. 9).

The resultant force and its location can be calculated from FIG. 10 in the following manner:

$F$=½*[(ARC LENGTH $A1$–$B1$ (OR $A2$–$B2$)IN MM)*MAXIMUM OIL PRESSURE IN BAR*GEAR WIDTH IN MM]/(10*10)Kgf.

$F$=½*107.1*250*37/(10*10)Kgf

F=4953 Kgf.

Location of Resultant Force—

$$C1(C2) = 2/3 * 107.1$$

$$= 71.4 \text{ MM}$$

As can be seen from FIG. 9, the major curvilinear axis of the bean-shaped dowel is located directly perpendicular to the line of resultant force "F", while the minor axis at the line of symmetricity aligns with the line of force. The effect of positioning the bean dowel in this manner eventually eliminates any possible chance of occurrence of turning moment, and thus reduces the possibilities of increased gear tip circle clearance.

The resultant force of 4953 kgf acts on the bean-shaped dowel cross-section of 44.2×15=663 sq. mm. (see FIG. 6 with T as 15 mm and length of curvilinear major axis as 44.2 mm) and the net compressive stress on each of the bean-shaped dowel amounts to 4953/663=7.47 kgf/sq. mm. The maximum bearing pressure for the dowel made of EN 8 material specification is allowed between 10 to 0.12 kgf/sq. mm. Hence, this clearly indicates that the maximum compressive stress is within the permissible limit and the design of the bean-shaped dowel is satisfactory from the strength point of view. It is also noted that the compressive stress acting on the bean-shaped dowel is 2.06 times less compared to the hollow dowel for gear pumps having similar flow and pressure ratings.

Figure 11:
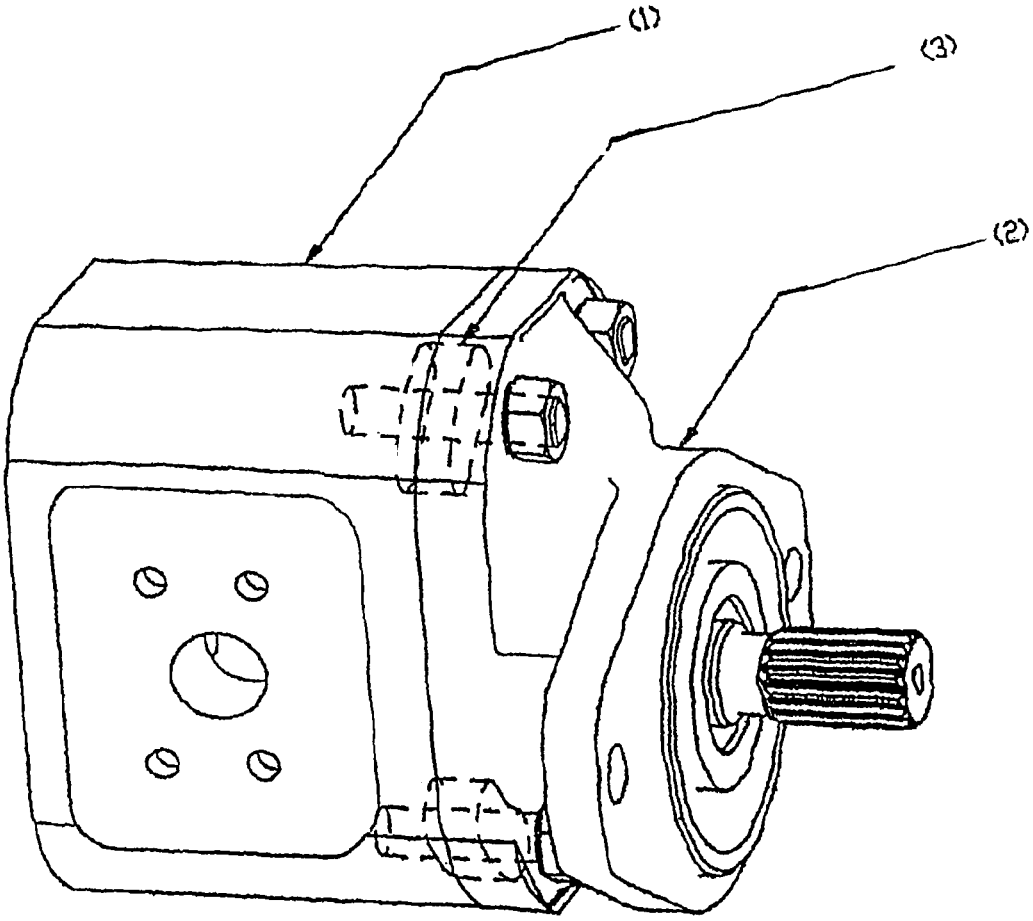
FIG. 11 shows an overall pump assembly.
Figure 12:
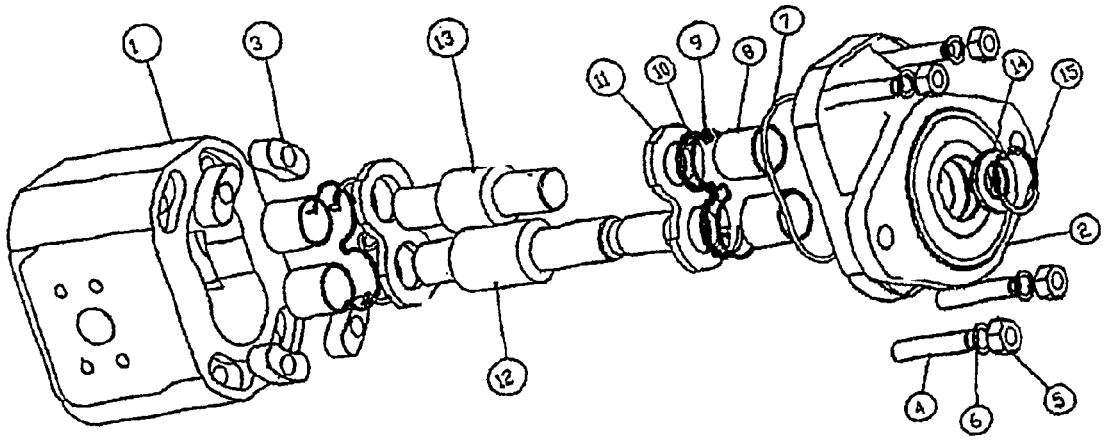
FIG. 12 is an exploded view of the pump assembly having an interlocking mechanism using bean-shaped dowels according to the present invention with the following parts list.

The overall pump assembly and the exploded view of the gear pump assembly having an interlocking mechanism using bean-shaped dowels according to the invention is depicted in FIGS. 11 and 12 respectively. The structural component parts of the pump are illustrated with the help of reference numerals.

The pump body (1) is made from high grade specially alloyed cast iron or aluminium materials depending upon the application and pressure ratings, whereas the flanges (2) are made from cast iron castings. The pump body and flange profiles are such that adequate reinforcing is maintained at appropriate zones to enhance its load bearing capacity and its rigidity, which in turn directly increases the pump pressure holding capacity. Both the pump body and flange are suitably adapted to accommodate bean-shaped interlocking dowels.

The pump gears (12, 13) are made from special steel with strict adherence to the heat treatment requirements arising from their operational requirements. While designing the gears, special attention has been paid to the load bearing property, particularly while catering to high pressure and high flow requirements. The optimum sizing of the journal diameter is one of the important parameters in this regard.

The specially designed oil seals (7, 10) known as body seal and lobe seal have been developed with a view to successfully cater to efficient sealing of pressurized oil pockets inside the pump. Along with lobe seal material, its profile which has to match with the corresponding pressure plate profile, is of crucial importance for the successful operation of the pump. Back-up rings (9) are used to prevent squeezing of lobe seal and to retain the lobe seal in its original position.

Pressure plates (11) are very important components of a hydraulic gear pump having an interlocking mechanism according to the invention. It can be regarded as a sole functionary responsible for the efficient functioning of the pump. The intricately machined profile of the plate and its material composition are of immense importance, since it has to optimally match with various other mating elements and operating conditions.

Optimally designed and appropriately dimensioned PTFE lined bush bearings (8) are used as a load bearing journal.

The bean-shaped dowels (3) {4 nos.} enable clamping both pump body and flange together resulting in a definitive near single unit for the pump assembly. This singular item is responsible for imparting the various advantages.

The present invention offers the following distinct advantages:

(a) Higher volumetric efficiency of the gear pump (b) Reduced heat loss due to lower internal oil leakage (c) Longer life of the pump since low internal heat generation results in higher performance and longevity of all the sealing materials (d) Suitable for design of hydraulic machine applicable for high pressure and unfavorable operating conditions.

With reference to the pump assembly shown in FIG. 11, during operation of the gear pump, a high pressure profile within the pump body (1) is generated with pressure varying from the suction to the outlet as shown in FIG. 9. The resultant of the hydraulic load "F" acts on the gear pump body. This force which has a magnitude proportional to the outlet oil pressure tends to cause spatial displacement for the pump body (1) with respect to the pump flange (2), thereby increasing the gear tip circle cutting into the pump body bore, and increasing the gear tip-body bore clearance. This phenomenon has a negative bearing on the volumetric efficiency of the pump as already discussed and hence, needs to be minimized.

The interlocking device acts in opposition with this disturbing hydraulic force "F", and assists in maintaining the dimensional rigidity between the pump body and the flange, and thus ensures reduced gear tip circle cutting into the pump body, resulting in maximization of volumetric efficiency.

Various alternatives of the possible modes of combining the pump body and flange using the conventional 2 hollow dowels and the proposed 4 bean-shaped dowels have been considered. Finite element analysis was carried out for both maximum deflection and principle stress values while employing gear pumps with the alternative interlocking arrangements mentioned above with a maximum pressure of 250 bar. The detailed analysis reveals the optimum suitability and superiority of the bean-shaped dowel mechanism over conventional techniques.

The salient features of the interlocking mechanism for gear pump using bean-shaped dowels according to the present invention can be appreciated by comparing the finite element method (FEM) analysis outputs for both conventional and the interlocking mechanism as per the invention.

Finite element analysis (FEA) was carried out in detail for both the conventional interlocking mechanism and for the interlocking mechanism according to the present invention. The summary of the deflection and stress analysis is given in Table-2. This FEA is based on an optimized body profile that can withstand pressure upto 275 bar and also intermittent pressure upto 330 bar.

TABLE 2

Summary of Deflection and Stress Analysis

| Sl. | Type of Interlocking Between Pump Body and Flange | Maximum Deflection Value in Micron | Maximum Deflection Location | Maximum Stress Value in $N/mm^2$ | Maximum Stress Location |
|---|---|---|---|---|---|
| 1 | 2 Hollow Dowels (Conventional) | 72 | Outlet Porting | 831 | Inlet Side Bolt Holes |
| 2 | 4 Bean-Shaped Dowels | 45 | Rear Portion of Pump Body | 260 | Inlet Side Bolt Holes |

The comparison as detailed above clearly indicates the superiority of the bean-shaped dowel over the conventional hollow dowel concept. The use of bean-shaped dowel as pump body-flange interlocking mechanism according to the present invention helps to achieve higher volumetric efficiency of the gear pump during operation at high pressure due to the fact that the relative deflection at the pump body-flange interface is minimized owing to higher rigidity in dowel mounting, as evidenced in the computation of bearing stress at the dowel.

Further, the use of four bean-shaped dowels (instead of two hollow dowels in the conventional technique) establishes an all around rigidity factor at the separating joint face.

The optimum location of the bean-shaped dowel having the curvilinear major axis aligned at right angle with the resultant force direction and the minor axis at the axis of symmetricity aligning with the resultant force direction ensures total avoidance of the turning couple while using the bean-shaped dowel. This mechanism assists in maintaining the oil tight chamber at the gear tip-body bore, thus ensuring higher pump volumetric efficiency.

The substantial variation in the volumetric efficiency during the operation of the gear pump at a wide range of varying pressure compared to the initial running-in pressure is considerably reduced since the pump gear deflection is minimized owing to the more rigid interface joint through four bean-shaped dowels.

As stated hereinabove, the location of occurrence for the maximum stress and deflection position are different in the bean-shaped dowel arrangement according to the present invention as compared to the oval-shaped dowel arrangement according to the main invention. The bean-shaped dowel according to the present invention is an improvement upon the oval-shaped dowel arrangement because of the following:

(a) Optimality on deflection and stress for hydraulic machine body while being used under extreme operating conditions, as would be clear from the figures in the Table below:

| Operating Pressure (bar) | Maximum Deflection in Micron: Bean-shaped | Maximum Deflection in Micron: Oval-shaped | Stress in N/sq. mm.: Bean-shaped | Stress in N/sq. mm.: Oval-shaped |
|---|---|---|---|---|
| 207 | 28 | 25 | 345 | 246 |
| 275 | 45 | 45 | 260 | 522 |

(b) The maximum bearing pressure on the bean-shaped dowel is less compared to oval-shaped dowel, viz., for oval-shaped dowel it is 9.1 Kgf/sq. mm. whereas for bean-shaped dowel it is 7.47 Kgf/sq. mm.

With the advent of CNC machining technology, the machining of the bean-shaped dowels and the corresponding dowel slots on the gear pump body and flange becomes highly reproducible and complimentary to their respective slots and dowels because of identical program being deployed for the machining.

The foregoing is to be considered as illustrative only of the principles of the present invention. Further, since numerous modifications and changes will readily occur to those skilled in the art, it is not desired to limit the invention to the exact construction and applications shown and described, and accordingly, all suitable modifications, developments and equivalents may be resorted to, falling within the scope of the invention in the appended claims and their equivalents. Although the invention has been described above with reference to a hydraulic gear pump, the scope of the invention is not limited to hydraulic gear pump alone and it can be employed in all hydraulic and other machines or devices including hydraulic pumps, motors, valves, etc. where containment of pressurized fluid is required with due consideration for minimal deflection of the load bearing elements.

The invention claimed is:

1. A hydraulic machine comprising a body, flange, gears, sealing means acting as a body seal and a lobe seal adapted to effectively seal pressurized oil pockets within said hydraulic machine with a back-up ring that prevents squeezing of said lobe seal and to retain said lobe seal in an original position, and appropriately dimensioned bush bearings adapted to act as load bearing journals, a plurality of bean-shaped dowels located at both inlet and outlet sides acting as an interlocking device holding the body and flange together with minimum relative displacement to ensure high volumetric efficiency of said hydraulic machine even at a high operating pressures of 275 bar or higher, said bean-shaped dowels have a curvature with a curvilinear major axis of each of the bean-shaped dowels being aligned at a right angle with respect to a resultant force direction and a minor axis at an axis of symmetricity being aligned with the resultant force direction, the resultant force direction extending through a center of one of the gears.

2. The hydraulic machine as claimed in claim 1, wherein the number of bean-shaped dowels used is in said interlocking device is four, which enables clamping of the body and the flange together.

3. The hydraulic machine as claimed in claim 1, wherein profiles of said body and the flange are such that adequate reinforcing is maintained at appropriate zones to enhance load bearing capacity and rigidity.

4. The hydraulic machine as claimed in claim 1, wherein a profile of the lobe seal material matches with a corresponding pressure plate.

5. The hydraulic machine as claimed in claim 1, wherein said hydraulic machine is a gear pump.

6. The hydraulic machine as claimed in claim 1, wherein the hydraulic machine withstands a pressure up to 330 bar.

* * * * *